US011259570B2

(12) United States Patent
Pan

(10) Patent No.: US 11,259,570 B2
(45) Date of Patent: Mar. 1, 2022

(54) ELECTRONIC CIGARETTE AND ATOMIZER THEREOF

(71) Applicant: SHENZHEN SMOORE TECHNOLOGY LIMITED, Shenzhen (CN)

(72) Inventor: Weidong Pan, Shenzhen (CN)

(73) Assignee: Shenzhen Smoore Technology Limited

( * ) Notice: Subject to any disclaimer, the term of this patent is extended or adjusted under 35 U.S.C. 154(b) by 339 days.

(21) Appl. No.: 16/073,360

(22) PCT Filed: Dec. 11, 2017

(86) PCT No.: PCT/CN2017/115486
§ 371 (c)(1),
(2) Date: Jul. 27, 2018

(87) PCT Pub. No.: WO2019/113747
PCT Pub. Date: Jun. 20, 2019

(65) Prior Publication Data

US 2019/0373949 A1 Dec. 12, 2019

(51) Int. Cl.
*A24F 40/44* (2020.01)
*A24F 40/10* (2020.01)
*A24F 40/42* (2020.01)

(52) U.S. Cl.
CPC ..... *A24F 40/44* (2020.01); *A24F 40/10* (2020.01); *A24F 40/42* (2020.01)

(58) Field of Classification Search
CPC ..... A24F 40/44; A24F 47/008
See application file for complete search history.

(56) References Cited

U.S. PATENT DOCUMENTS 5,160,518 A 11/1992 Vega
9,861,141 B1 1/2018 Liu
(Continued)

FOREIGN PATENT DOCUMENTS

CN 203523811 U 4/2014
CN 103960782 A 8/2014
(Continued)

OTHER PUBLICATIONS

European Patent Office, European Search Report, Documents Considered to be Relevant, dated Jul. 26, 2019.
(Continued)

*Primary Examiner* — Michael J Felton
*Assistant Examiner* — Katherine A Will
(74) *Attorney, Agent, or Firm* — Mark Malek; Widerman Malek, PL

(57) ABSTRACT

An atomizer (100) includes a liquid reservoir (120) and a heating assembly. The liquid reservoir (120) has a liquid storage cavity (122) for receiving an atomizing liquid, wherein the liquid reservoir (120) has an opening end (121). The heating assembly (130) includes a liquid conducting body (131) and the heating element (132), the liquid conducting body (131) is located on the opening end (121), the conducting body (131) has a liquid absorbing surface (131*a*) facing an inside of the liquid storage cavity (122) and a atomizing surface (131*b*) located outside of the liquid storage cavity (131*b*), the heating element (132) is formed on the atomizing surface (131*b*), the liquid conducting body (131) is configured to conduct the atomizing liquid in the liquid storage cavity (122) to the atomizing surface (131*b*), and the heating element (132) is configured to atomize the atomizing liquid conducted to the atomizing surface (131*b*).

19 Claims, 6 Drawing Sheets

(56) References Cited

U.S. PATENT DOCUMENTS

| | | | | |
|---|---|---|---|---|
| 9,943,108 | B2 * | 4/2018 | Lord | A24F 40/42 |
| 2013/0081623 | A1 * | 4/2013 | Buchberger | A61M 11/041 128/203.27 |
| 2015/0040929 | A1 * | 2/2015 | Hon | A24F 47/008 131/329 |
| 2015/0208729 | A1 | 7/2015 | Monsees et al. | |
| 2015/0245669 | A1 * | 9/2015 | Cadieux | A24F 40/465 131/329 |
| 2016/0007655 | A1 | 1/2016 | Li et al. | |
| 2016/0095354 | A1 | 4/2016 | Wu | |
| 2017/0215481 | A1 | 8/2017 | Li et al. | |
| 2018/0369519 | A1 * | 12/2018 | Adelson | A61M 11/042 |

FOREIGN PATENT DOCUMENTS

| | | | |
|---|---|---|---|
| CN | 104720117 | B | 6/2015 |
| CN | 204409592 | U | 6/2015 |
| CN | 104824853 | A | 8/2015 |
| CN | 104824853 | B | 8/2015 |
| CN | 105559147 | B | 5/2016 |
| CN | 105705048 | A | 6/2016 |
| CN | 106136327 | A * | 11/2016 |
| CN | 106136327 | A | 11/2016 |
| CN | 205695694 | U | 11/2016 |
| CN | 206565287 | U | 12/2016 |
| CN | 205865992 | U | 1/2017 |
| CN | 106418709 | A | 2/2017 |
| CN | 206119186 | U | 4/2017 |
| CN | 106820271 | B | 6/2017 |
| CN | 1062820271 | A | 6/2017 |
| CN | 207784278 | U | 8/2018 |
| EP | 3287017 | A1 | 6/2015 |
| EP | 3287017 | A1 | 2/2018 |
| JP | 07113469 | A | 2/1995 |
| KR | 2020140002296 | | 4/2014 |
| WO | 2014089283 | | 6/2014 |
| WO | 2015077645 | | 5/2015 |
| WO | 2016161554 | A1 | 10/2016 |
| WO | 2017048782 | A1 | 3/2017 |
| WO | 2017143865 | A1 | 8/2017 |

OTHER PUBLICATIONS

State Intellectual Property Office. Chinese Office Action, References Cited, dated Mar. 8, 2019.

Japanese Office action in related foreign application dated May 19, 2020; 5 pages.

Canadian Office action in related foreign application dated Jul. 22, 2020; 5 pages.

Korean Office action in related foreign application 9-5-2020081147975 dated Dec. 2, 2020; 56 pages.

Notice of Opposition in related European patent 17892066.6 dated Sep. 13, 2021; 30 pages.

Notice of Opposition in related European patent 17892066.6 dated Sep. 13, 2021; 54 pages.

* cited by examiner

ELECTRONIC CIGARETTE AND ATOMIZER THEREOF

CROSS REFERENCE TO RELATED APPLICATIONS

This is a national stage application under 35 U.S.C. § 371 of PCT parent application PCT/CN2017/115486, filed on Dec. 11, 2017 which is hereby incorporated by reference in its entirety.

TECHNICAL FIELD

The present disclosure relates to the technical field of smoking device, particularly relates to an electronic cigarette and an atomizer thereof.

BACKGROUND

An electronic cigarette is also known as a virtual cigarette. Since an electronic cigarette has the similar appearance and taste of cigarette, but generally does not contain harmful ingredients, such as tar and particulate matter, it is widely welcomed by users.

An atomizer is a key device in an electronic cigarette, which is used to store atomizing liquid, and to atomize the atomizing liquid. In a conventional electronic cigarette, the atomizer has a complex structure, and it is time-consuming and laborious to assemble.

SUMMARY

Accordingly, it is necessary to provide an electronic cigarette and an atomizer thereof with a simple structure and easy assembly.

An atomizer includes:

a liquid reservoir having a liquid storage cavity for receiving atomizing liquid, and the liquid reservoir has an opening end, the opening end defines an opening in communication with the liquid storage cavity;

a heating assembly, including a liquid conducting body and a heating element, the conducting body is located on the opening end, the conducting body has a liquid absorbing surface facing an inside of the liquid storage cavity and a atomizing surface located outside of the liquid storage cavity, the heating element is formed on the atomizing surface, the liquid conducting body is configured to conduct the atomizing liquid in the liquid storage cavity to the atomizing surface, and the heating element is configured to atomize the atomizing liquid conducted to the atomizing surface; the liquid absorbing surface defines a recess, and an minimum conduction distance of the atomizing liquid from a bottom wall of the recess to the atomizing surface is less than a minimum conduction distance of the atomizing liquid from the liquid absorbing surface to the atomizing surface.

An electronic cigarette includes:

an aforementioned atomizer; and a battery device including a cover, a battery and a pogo pin, the battery is received in the cover, the pogo pin is mounted on the cover, and the pogo pin is electrically connected to the battery and the heating element, respectively.

The details of one or more embodiments of present disclosure are set forth in the accompanying drawings and the description below. Other features, objects, and advantages of present disclosure will be apparent from the description and drawings, and from the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Embodiments of the present disclosure are described more fully hereinafter with reference to the accompanying drawings. A preferred embodiment is described in the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Unless otherwise defined, all terms (including technical and scientific terms) used herein have the same meaning as commonly understood by one of ordinary skill in the art to which this invention belongs. The terms used herein is for the purpose of describing particular embodiments only and is not intended to limit the present disclosure. As used herein, the term "and/or" includes any and all combinations of one or more of the associated listed items.

Figure 1:
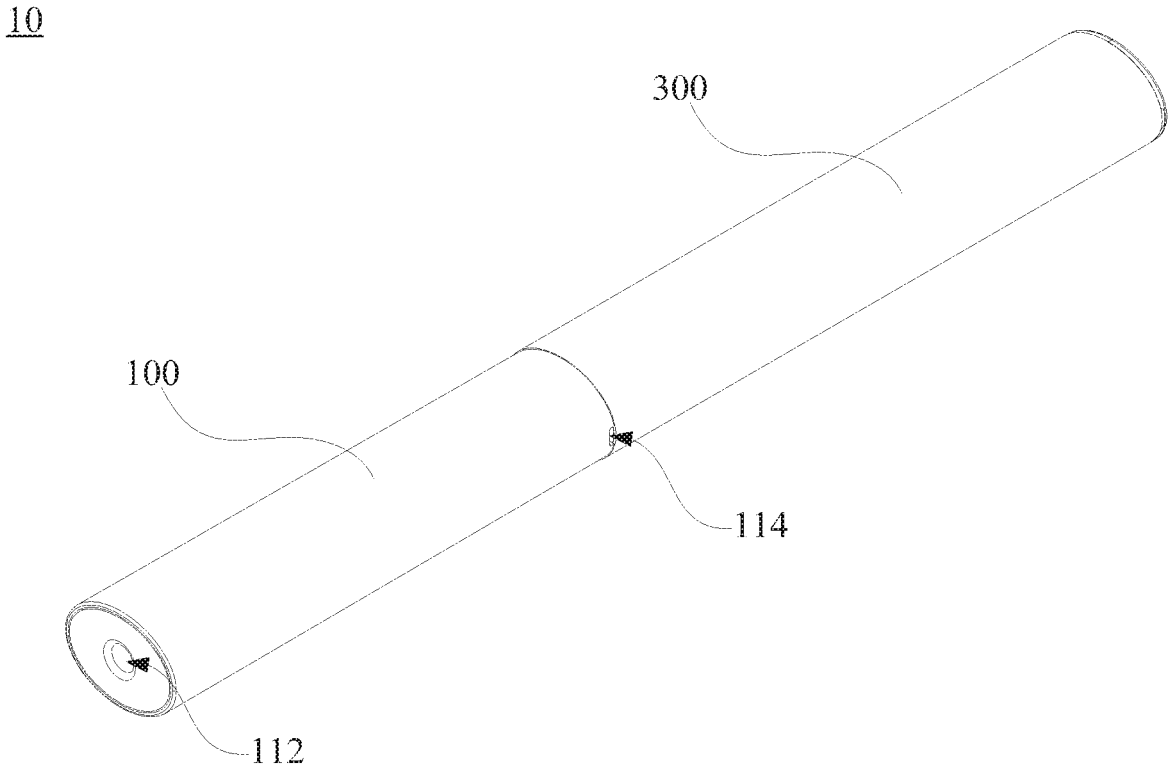
FIG. 1 is a schematic view of an electronic cigarette according to an embodiment.

Referring to FIG. 1, an electronic cigarette 10 according to an embodiment includes an atomizer 100 and a battery device 300. The battery device 300 is connected to the atomizer 100, and the battery device 300 is used to power the atomizer 100.

Figure 2:
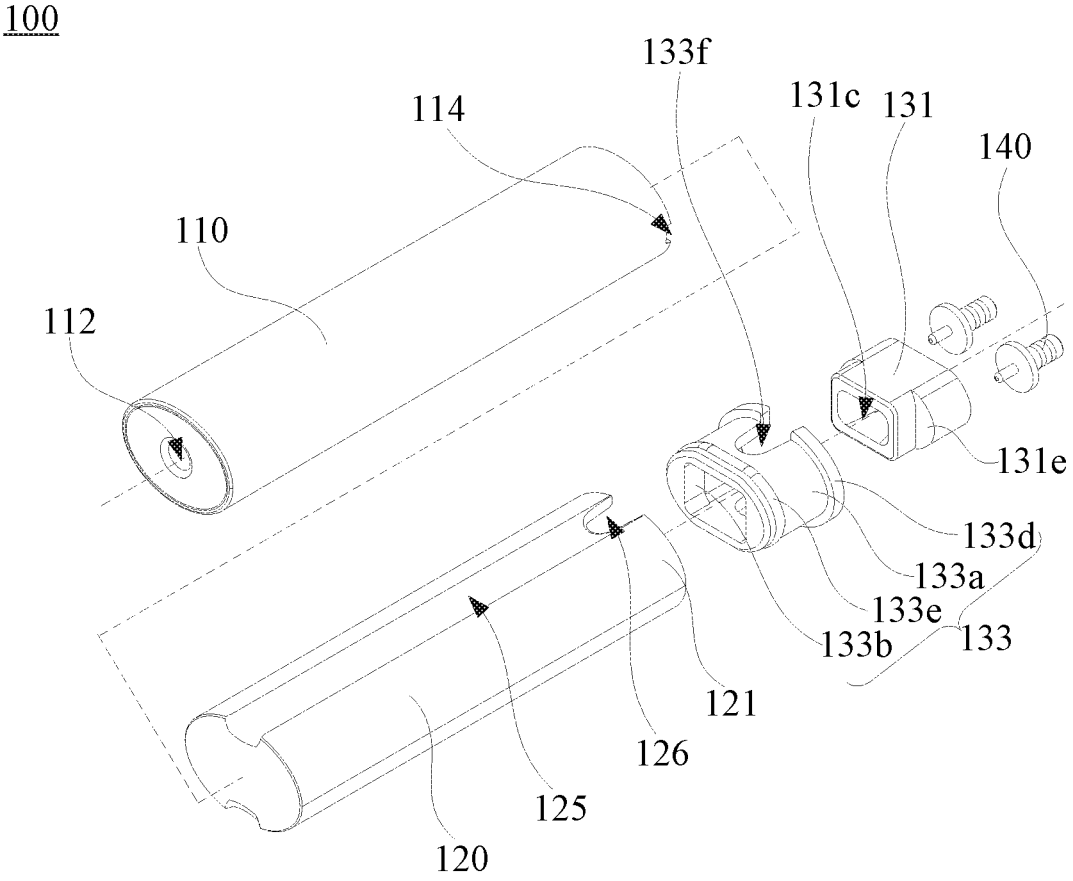
FIG. 2 is an exploded view of an atomizer of the electronic cigarette of FIG. 2.
Figure 3:
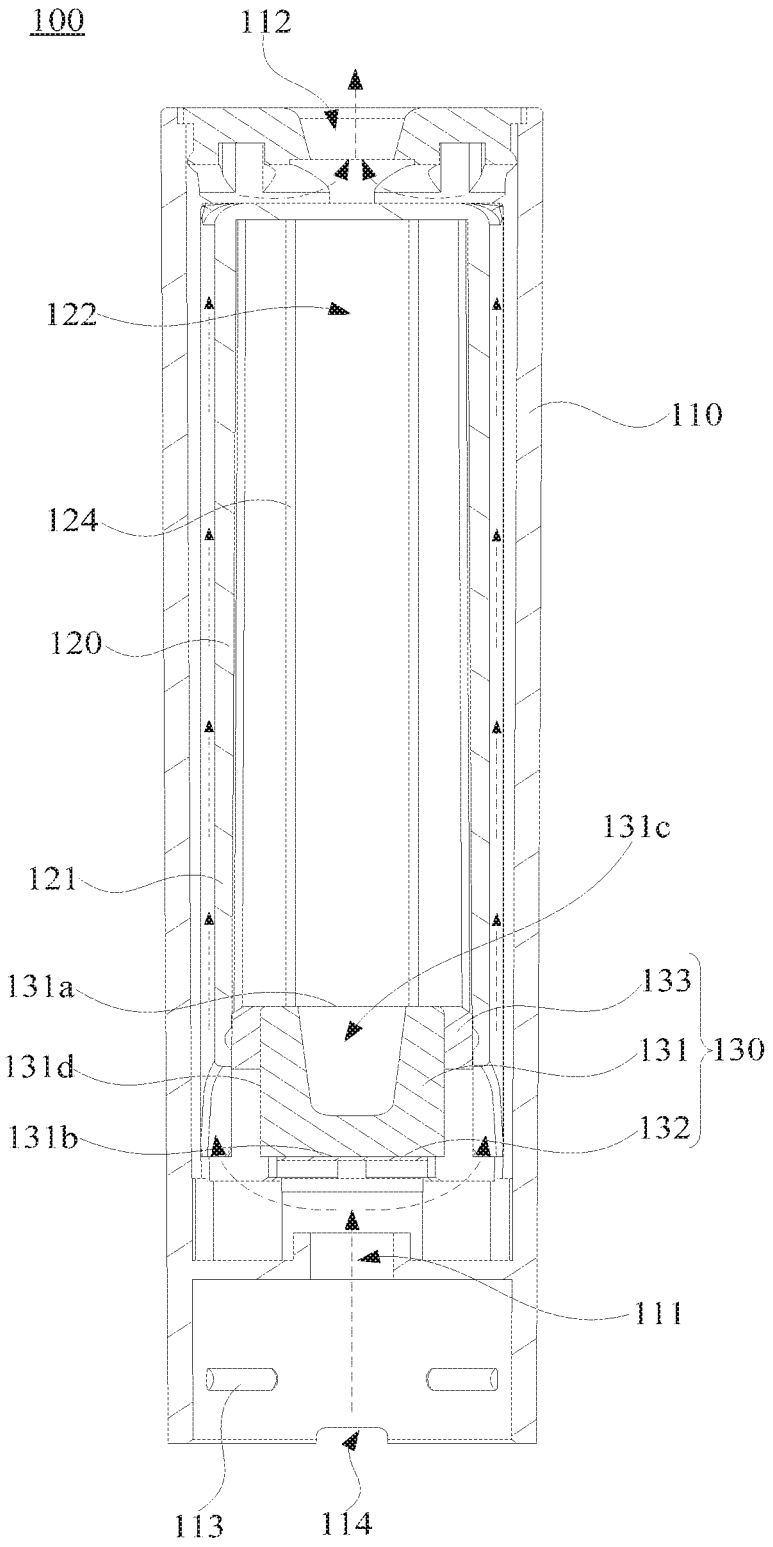
FIG. 3 is a cross-sectional view of the atomizer of the electronic cigarette of FIG. 2.
Figure 4:
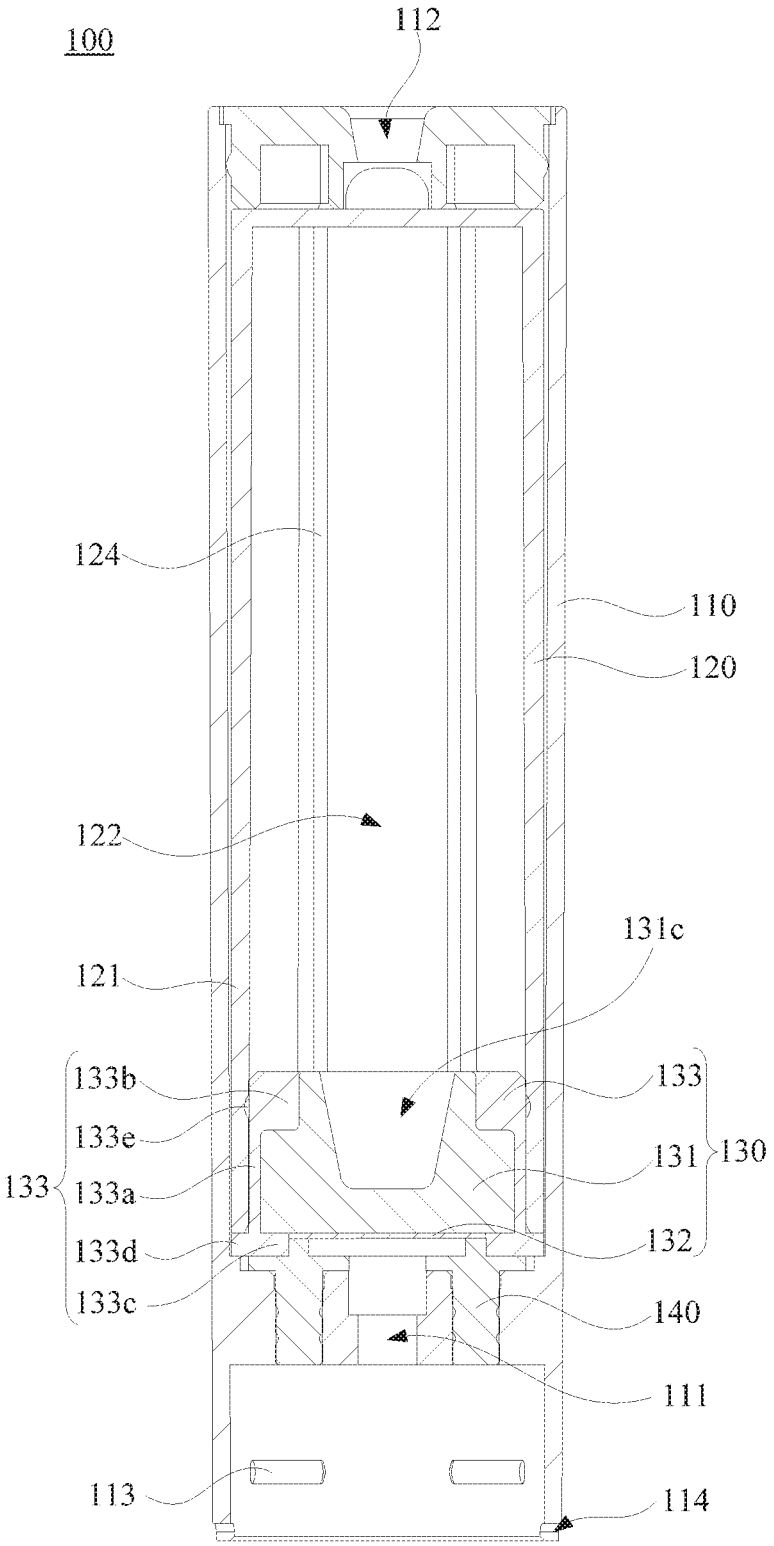
FIG. 4 is another cross-sectional view of the atomizer of the electronic cigarette of FIG. 2.

Referring to FIG. 2, FIG. 3, and FIG. 4, the atomizer 100 includes a liquid reservoir 120 and a heating assembly 130. The liquid reservoir 120 has a liquid storage cavity 122 used to receive atomizing liquid, the liquid reservoir 120 also has an opening end 121, and the opening end 121 defines an opening in communication with the liquid storage cavity 122. The liquid reservoir 120 can be a hollow structure of a tubular shape, a cubic shape, a spherical shape or the like that can receive the atomizing liquid. The heating assembly 130 is connected to the liquid reservoir 120, so as to absorb and atomize the atomizing liquid stored in the liquid storage cavity 122.

The heating assembly 130 includes a liquid conducting body 131 and a heating element 132. The liquid conducting body 131 is located on the opening end 121, and the conducting body 131 has a liquid absorbing surface 131*a* facing an inside of the liquid storage cavity 122, and has an atomizing surface 131*b* located outside of the liquid storage cavity 122, the liquid conducting body 131 conducts the atomizing liquid in the liquid storage cavity 122 to the atomizing surface 131*b*. The heating element 132 is formed on the atomizing surface 131*b*, and the heating element 132 atomizes the atomizing liquid conducted to the atomizing surface 131*b*, so as to obtain an atomized gas for smoking.

In addition, the liquid absorbing surface 131*a* defines a recess 131*c*, and an minimum conduction distance of the atomizing liquid from a bottom wall of the recess 131*c* to the atomizing surface 131*b* is less than a minimum conduction distance of the atomizing liquid from the liquid absorbing surface 131*b* to the atomizing surface 131*b*. In the illustrated embodiment, the liquid conducting body 131 can be of any shape. The liquid absorbing surface 131*a* and the atomizing surface 131*b* can be a flat surface or a curved surface. The liquid absorbing surface 131*a* and the atomizing surface 131*b* can be arranged in parallel, or form a certain angle. When no recess 131*c* is formed on the liquid absorbing surface 131*a*, the atomizing liquid has a minimum conduction distance, and when the recess 131*c* is defined on the liquid absorbing surface 131*a*, another minimum conduction distance is formed between an bottom wall of the recess 131*c* and the atomizing surface 131*b*. Since the minimum conduction distance of the atomizing liquid from the bottom wall of the recess 131*c* to the atomizing surface 131*b* is further less than the minimum conduction distance of the atomizing liquid from the liquid absorbing surface 131*a* to the atomizing surface 131*b*, the atomizing liquid can enter the recess 131*c* quickly and travel along the a shortest traveling path formed between the bottom wall of the recess 131*c* and the atomizing surface 131*b*, such that a conduction distance of the atomizing liquid is reduced, the resistance subjected during the flow of the atomizing liquid is reduced, and the conduction efficiency of the liquid conducting body 131 is improved. Meanwhile, compared with the solution in which the recess 131*c* is not formed on the liquid absorbing surface 131*a*, the liquid conducting body 131 of this solution has a greater contact area with the atomizing liquid, which facilitates the conduction of the atomizing liquid, and also increases the volume of the liquid storage cavity 122, so as to increase the amount of liquid stored in the liquid storage cavity 122.

Figure 5:
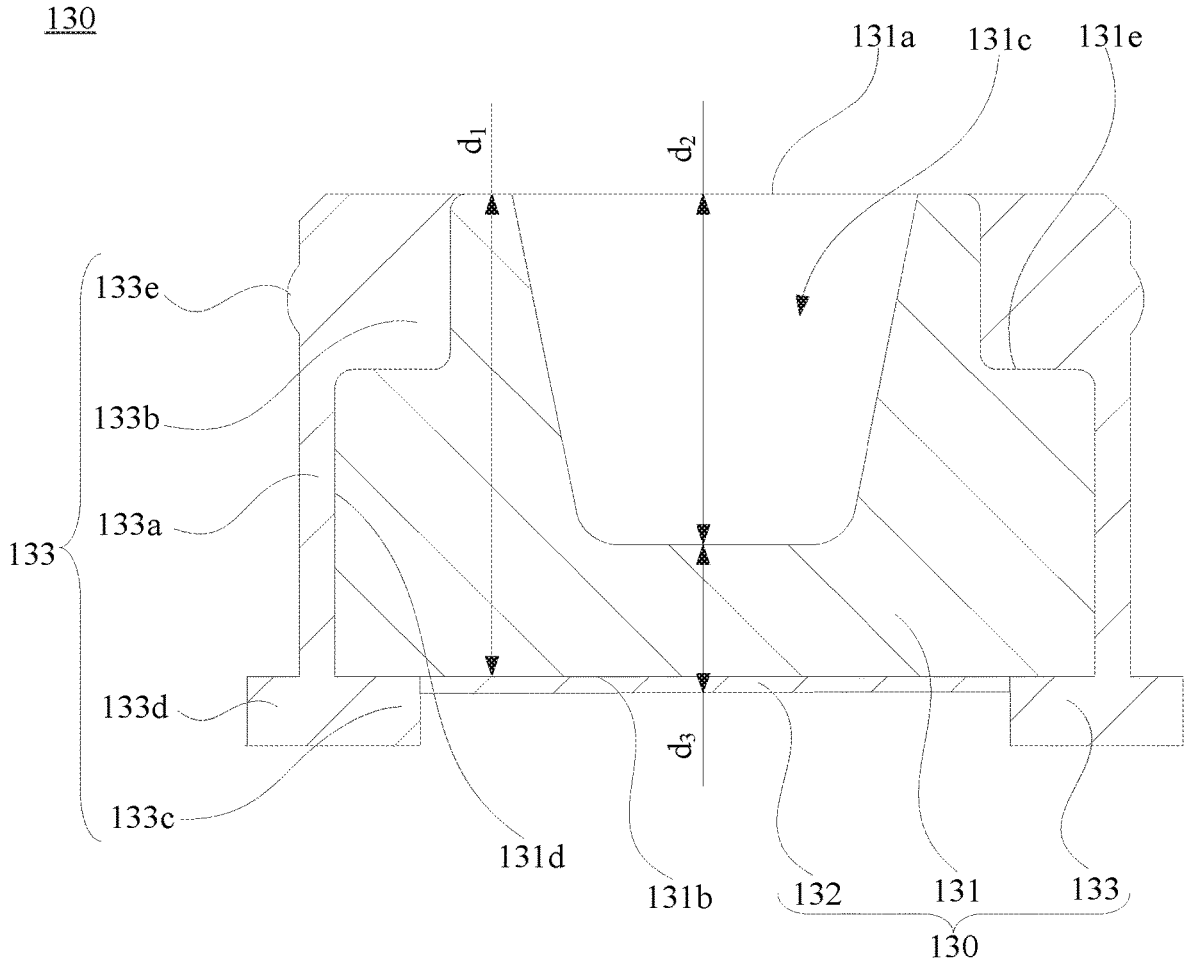
FIG. 5 is a cross-sectional view of a heating assembly of the atomizer of FIG. 4.

Referring to FIG. 5, in one of the embodiments, the liquid absorbing surface 131*a* and the atomizing surface 131*b* are located on opposite sides of the liquid conducting body 131, and the liquid conducting body 131 further includes a side surface 131*d* connecting the liquid absorbing surface 131*a* and the atomizing surface 131*b*. In the illustrated embodiments, the liquid conducting body 131 is of a columnar structure, and the two opposite end surfaces of the liquid conducting surface 131*a* are the liquid absorption 131*a* and the atomizing surface 131*b*, which are arranged in parallel. At this time, a minimum transportation distance $d^1$ between the liquid absorbing surface 131*a* and the atomizing surface 131*b* is the perpendicular distance between the liquid absorbing surface 131*a* and the atomizing surface 131*b*. By providing the side surface between the liquid absorbing surface 131*a* and the atomizing surface 131*b*, the liquid conducting body 131 has a certain thickness.

In one of the embodiments, the recess 131*c* extends along a direction from the liquid absorbing surface 131*a* to the atomizing surface 131*b*. The bottom wall of the recess 131*c* can be a curved surface, or a planar surface that is parallel to the atomizing surface 131*b*, or forms an angle with the atomizing surface 131*b*, or any other shape. Regardless of the shape of the bottom wall of the recess 131*c*, the recess 131*c* extends along a linear direction perpendicular to the atomizing surface 131*b* and approaches the atomizing surface 131*b*. In this case, a flowing path of the atomizing liquid along the recess 131*c* is a straight line, therefore this configuration can prevent the problem of a relatively large resistance of the atomizing liquid caused by a longer flowing path of the atomizing liquid along the recess 131*c* when the recess 131*c* is curved, so as to shorten the flowing path of the atomizing liquid along the recess 131*c*, reduce the resistance to the atomizing liquid, and improve a transfer efficiency of the atomizing liquid. Meanwhile, a depth $d_2$ of the recess 131*c* is a distance from the bottom wall of the recess 131*c* to the liquid absorbing surface 131*a*, and the minimum conduction distance $d_3$ from the bottom wall of the recess 131*c* to the liquid absorbing surface is a distance from a position at the bottom wall of the recess 131*c* farthest from the liquid absorbing surface 131*a* to the atomizing surface 131*b*. When the atomizing liquid enters the recess 131*c*, the atomizing liquid will be conducted from the position at the bottom wall of the recess 131*c* farthest from the liquid absorbing surface 131*a* to the atomizing surface 131*b*.

Additionally, in one of the embodiments, the minimum conduction distance between the bottom wall of the recess 131*c* and the atomizing 131*b* is less than the depth of the recess 131*c*, in this way, the minimum conduction distance d3 between the bottom wall of the recess 131*c* is further less than the depth d2 of the recess 131*c*. When the thickness of the liquid conducting body 131 is constant, the minimum conduction distance d3 can be reduced via increasing the depth d2 of the recess 131*c*, such that the atomizing liquid can flow to a position at the bottom wall of the recess 131*c* that nearest to the atomizing surface 131*b* as soon as possible, and the atomizing liquid can be conducted through the minimum conduction distance d3 between the bottom wall of the recess 131*c* and the atomizing surface 131*b* to the atomizing surface 131*b* under a relatively less resistance, so as to improve the conduction efficiency of the liquid conducting body 131.

In one of the embodiments, a cross-sectional area of the recess gradually decreases along a direction from the liquid absorbing surface 131*a* to the atomizing surface 131*b*, such that the recess 131*c* can have a relatively greater opening at the liquid absorbing surface 131*a*, and the atomizing liquid can enter the recess 131*c* smoothly without forming a film at the opening of the recess 131*c* to block the atomizing liquid from flowing along the recess 131*c*. The recess 131*c* can have a step shape, a cone shape, or a frustum shape.

In one of the embodiments, the bottom wall of the recess 131*c* is parallel to the atomizing surface 131*b*. In this case, the minimum conduction distance between the bottom wall of the recess 131*c* and the atomizing surface 131*b* is the distance between the bottom wall of the recess 131*c* and the atomizing surface 131*b*. The atomizing liquid can be conducted to the atomizing surface 131*b* with the minimum conduction distance from any position at the bottom wall of the recess 131*c*, thus the conduction efficiency of the liquid conducting body 131 is further improved.

In one of the embodiments, the liquid conducting body 131 is a porous body. The liquid conducting body 131 defines a plurality of micropores, and the atomizing liquid can flow along the micropores and be conducted to the atomizing surface 131*b*. Pore size of the micropores can be adjusted according to the type of the atomizing liquid, for example, if the viscosity of the atomizing liquid is large, a liquid conducting body 131 with greater pore size can be selected, such that the conduction efficiency of the liquid conducting body 131 is moderate. Moreover, in one of the embodiments, the liquid conducting body 131 is a porous ceramic.

In one of the embodiments, the heating element 132 can be a heating coat, a heating circuit, a heating chip, or a heating net. The heating coat can be coated on the atomizing surface 131*b*. The heating circuit can be plated on the atomizing surface 131*b*. The heating chip and the heating net can be mounted on the atomizing surface 131*b* via other auxiliary mounting means. The heating element 132 has a thin layer structure aligned with the atomizing surface 131*b*, so as to uniformly heat the atomizing surface 131*b*, such that the temperature for atomizing is consistent to avoid greater atomized particles caused by local lower temperatures, the atomized particles are uniform and the taste of the electronic cigarette is improved. Meanwhile, the heating element 132 has a greater contact area with the atomizing liquid, so as to improve the atomization efficiency.

Referring to FIG. 2 to FIG. 5, in one of the embodiments, the heating assembly 130 further includes a sealing element 133, which is at least partially located between the liquid conducting body 131 and the liquid reservoir 120, so as to prevent the atomizing liquid in the liquid reservoir 120 from directly flowing out without passing through the liquid conducting body 131. Because of the sealing effect of the sealing element 133, the atomizing liquid in the liquid reservoir 120 can only be conducted along the conduction path between the liquid absorbing surface 131*a* and the atomizing surface 131*b*. Furthermore, the liquid conducting body 131 is required to have a certain thickness to satisfy a mounting requirement of the sealing element 133, defining the recess 131*c* on the liquid absorbing surface 131*a* can make the liquid conducting body 131 not only meet the requirement of thickness, but also meet the requirement of conduction efficiency.

Additionally, in one of the embodiments, a side of the liquid conducting body 131 adjacent to the liquid absorbing surface 131*a* extends into the opening of the liquid reservoir 120. The sealing element 133 includes a sealing body 133*a*, which is sleeved on a side surface 131*d* of the liquid conducting body 131, and abuts against an inner wall of the liquid reservoir 120, so as to seal a gap between the liquid conducting body 131 and the inner wall of the liquid reservoir 120.

In one of the embodiments, the sealing element 133 further includes a first latching portion 133*b* and a second latching portion 133*c*. The first latching portion 133*b* is formed on an end of the sealing body 133*a* adjacent to the liquid absorption 131*b*, and the second latching portion 133*c* is formed on an end of the sealing body 133*a* adjacent to the atomizing surface 131*b*. The first latching portion 133*b* and the second latching portion 133*c* are latched to both ends of the liquid conducting body 131, respectively, so as to limit the relative mounting of the liquid conducting body 131 and the sealing element 133, which not only facilitates the mounting of the liquid conducting body 131 and the sealing element 133, but also prevents the liquid conducting body 131 from separating with the sealing element 133 to ensure an effective sealing of the sealing body 133*a*. Moreover, in one of the embodiments, the first latching portion 133*b* and the second latching portion 133*c* are both formed on an inner wall of the sealing body 133*a*. A boss portion 131*e* is formed on the side wall 131*d* of the liquid conducting body 131, the first latching portion 133*b* abuts against the boss portion 131*e*, and the second latching portion 133*c* abuts against the atomizing surface 131*b*, so as to limit the position of the liquid conducting body 131.

In one of the embodiments, the sealing element 133 further includes a third latching portion 133*d*. The third latching portion 133*d* is formed on an end of an outer wall of the sealing body 133*a* adjacent to the atomizing surface 131*b*, and the third latching portion 133*d* abuts against the end surface of the opening end 121 of the liquid reservoir 120. The configuration of the third latching portion 133*d* can limit the mounting of the heating assembly 130 at the opening of the liquid reservoir 120, so as to prevent the sealing element 133 and the liquid conducting body 131 from extending into the opening too deep, and to facilitate the mounting of the heating assembly 130 and the liquid reservoir 120.

In one of the embodiments, the sealing element 133 further includes a sealing ring 133*e* formed on an end of an outer wall of the sealing body 133*a* adjacent to the liquid absorbing surface. The sealing ring 133*e* can firmly abut against an inner wall of the liquid reservoir 120, so as to improve the sealing between the liquid conducting body 131 and the liquid reservoir 120.

In one of the embodiments, the sealing element 133 is an integrated structure. The sealing body 133*a*, the first latching portion 133*d*, the second latching portion 133*c*, the third latching portion 133*d* and the sealing ring 133*e* are integrally formed. The sealing element 133 can be made of silicone material, or other materials with sealing and thermal insulation features. The sealing element 133 enwraps the liquid conducting body 131, so as to reduce the unnecessary volatilization of the atomizing liquid, and also to achieve a thermal insulation effect. The silicon material can also avoid a hard contact between the liquid conducting body 131 and other parts, so as to avoid a damage of the liquid conducting body 131.

Referring to FIG. 2 to FIG. 4, in one of the embodiments, an side of the liquid conducting body 131 adjacent to the liquid absorbing surface 131*a* extends into the opening of the liquid reservoir 120. The inner wall of the liquid reservoir 120 is provided with a strengthening rib 124, which is capable of abutting against a side of the heating assembly 130 located in the liquid storage cavity 122. Furthermore, the strengthening rib 124 can abut against the liquid absorbing surface 131*a* of the liquid conducting body 131, so as to limit a depth of the liquid conducting body 131 extending into the liquid reservoir 120. Alternatively, when the sealing body 133*a* is sleeved on the side surface 131*d* of the liquid conducting body 131 and abuts against the inner wall of the liquid reservoir 120, the strengthening rib 124 can also abut against an end of the sealing element 133 adjacent to the liquid absorbing surface 131*a*, so as to limit a depth of the sealing element 133 extending into the liquid reservoir 120. Alternatively, the strengthening rib 124 can simultaneously abut against end surfaces of the liquid absorbing surface 131*a* of the liquid conducting body 131 and the sealing element 133, so as to limit a depth of the heating assembly 130 extending into the liquid reservoir 120. According to an embodiment, according to an embodiment, a plurality of the strengthening ribs 124 are provided, and the plurality of strengthening ribs 124 are uniformly distributed along a peripheral wall surface of the liquid reservoir 120, so as to apply a uniform force to the end of the heating assembly 130 located in the liquid storage cavity 122.

In one of the embodiments, the atomizer 100 further includes a housing 110. The housing 110 defines an air inlet 111 and an air outlet 112, the heating assembly 130 and the liquid reservoir 120 are received in the housing 110. The heating assembly 130 is located adjacent to the air inlet 111, and an airflow passage communicating the air inlet 111 and the air outlet 112 is provided between the housing 110 and the liquid reservoir 120. Airflow can enter from the air inlet 111, and the atomized gas obtained via an atomization of the heating element 132 flows along with the airflow, passes through the airflow passage and flows out from the air outlet 112 for smoking.

Moreover, in one of embodiments, the liquid reservoir 120 has a long tubular structure, and an outer wall of the liquid reservoir 120 is slightly less than an inner wall of the housing 110, such that the liquid reservoir 120 can be received in the housing 110. A gap between the outer wall of the liquid reservoir 120 and the inner wall of the housing 110 is relatively small, which is not conducive for the airflow and the atomized gas to be conducted out. A longitudinal groove 125 is defined on the outer wall of the liquid reservoir 120, such that an airflow passage is formed between the liquid reservoir 120 and the housing 110, so as to facilitate the airflow flowing along the longitudinal groove 125 and being conducted to the air outlet 112. Alternatively, the longitudinal groove 125 can be defined on the inner wall of the housing 110. Alternatively, the longitudinal grooves 125 can be simultaneously defined on the outer wall of the liquid reservoir 120 and the inner wall of the housing 110. Moreover, two longitudinal grooves 125 can be defined on the outer wall of the liquid reservoir 120, and the two longitudinal grooves 125 are oppositely arranged, so as to form two symmetrical airflow passages between the liquid reservoir 120 and the housing 110, such that a flux of gas and the atomized gas is increased, and the smoking taste is improved.

In one of the embodiments, a portion of the sealing element 133 is located between the liquid conducting body 131 and the liquid reservoir 120, so as to seal a gap between the liquid reservoir 120 and the liquid conducting body 131. The portion of the sealing element 133 abuts against the inner wall of the housing 110, such that more airflow entering through the air inlet 111 can reach the heating element 132 and is fully mixed with the atomized gas, so as to carry more atomized gas to the air outlet 112. At this time, the sealing element 133 defines a first notch **133*f*, the opening end 121 of the liquid reservoir 120 defines a second notch 126, and the first notch 133*f* and the second notch 126 communicate the air inlet 111 and the longitudinal groove 125. The airflow carrying the atomized gas enters the longitudinal groove 125 through the first notch 133*f* and the second notch 126, and is conducted out through the air outlet 112. Moreover, both of the number of the first notch 133*f* and the second notch 126 are two, such that two longitudinal grooves 125 can be in communication with the air inlet 111**.

Figure 6:
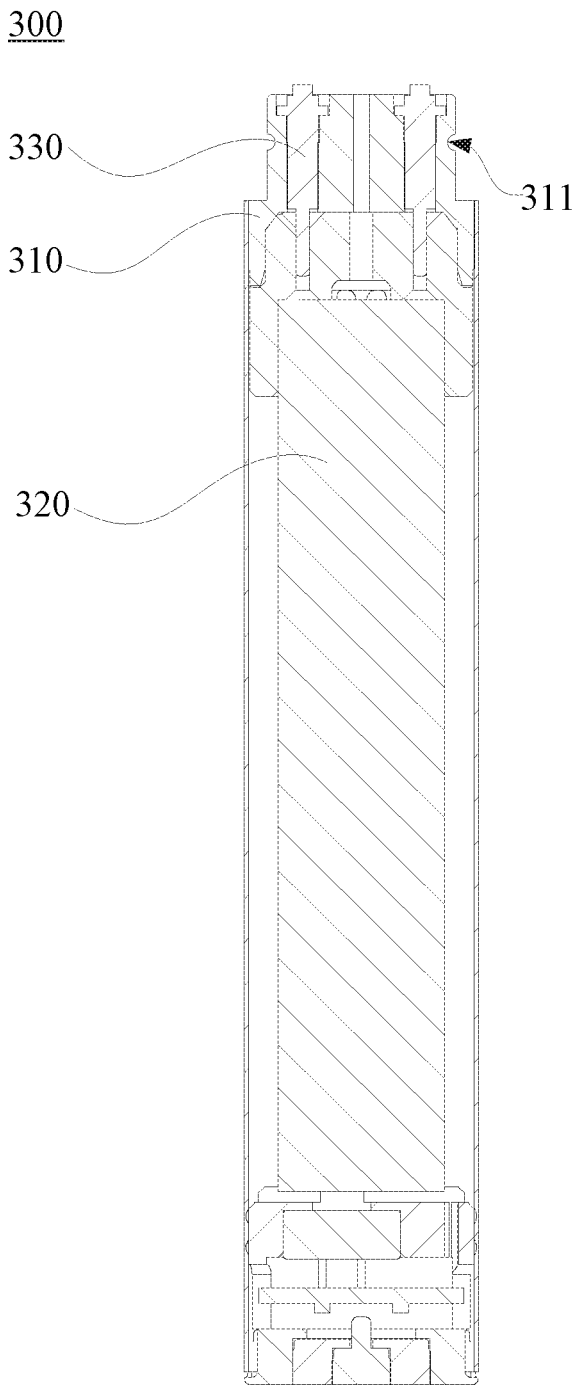
FIG. 6 is cross-sectional view of a battery device of the electronic cigarette of FIG. 2.

Referring FIG. 1 and FIG. 6, in one of the embodiments, the battery device 300 includes a cover 310, a battery 320 and a pogo pin 330. The battery 320 is received in the cover 310, the pogo pin 330 is mounted on the cover 310, and is electrically connected to the battery 320 and the heating element 132, respectively. Referring to FIG. 2 and FIG. 4, in one of the embodiments, the atomizer 100 further includes an electrode 140, the electrode 140 is mounted on the housing 110, and is electrically connected to the heating element 132. The pogo pin 330 is electrically connected to the electrode 140, so as to power the heating element 132 via the electrode 140. In one of the embodiments, the cover 310 latches with the housing 110, so as to achieve a fast dismounting of the battery device 300 and the atomizer 100. Moreover, referring to FIG. 4 and FIG. 6, an end of the cover 310 is received in the housing 110, and the inner wall of the housing 110 is provided with a protruded portion 113, an outer wall of the cover 310 defines a limiting groove 311, and the protruded portion 113 can latches into the limiting groove 311, so as to achieve a fast connection of the housing 110 and the cover 310. Alternatively, an end of the housing 110 can be received in the cover 310. Moreover, the housing defines an inlet notch 114, and a certain gap between the cover 310 and the housing 110 forms an inlet passage, the inlet passage is connected to the inlet 11 of the housing 110, and the airflow passes through the inlet passage between the cover 310 and the housing 110, then enters the housing 110 through the inlet 111.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although present disclosure is illustrated and described herein with reference to specific embodiments, the present disclosure is not intended to be limited to the details shown. It is to be noted that, various modifications may be made in the details within the scope and range of equivalents of the claims and without departing from the present disclosure. Therefore, the protection scope of the present disclosure shall be subject to the protection scope of the claims.

That Which is claimed is:

1. An atomizer, comprising:

a liquid reservoir having a liquid storage cavity for receiving atomizing liquid, wherein the liquid reservoir has an opening end, and the opening end defines an opening in communication with the liquid storage cavity;

a heating assembly comprising a liquid conducting body and a heating element, wherein the liquid conducting body is located on the opening end, the conducting body has a liquid absorbing surface facing an inside of the liquid storage cavity and an atomizing surface located outside of the liquid storage cavity, the heating element is formed on the atomizing surface, the liquid conducting body is configured to conduct the atomizing liquid in the liquid storage cavity to the atomizing surface, and the heating element is configured to atomize the atomizing liquid conducted to the atomizing surface; the liquid absorbing surface defines a recess extending from the liquid absorbing surface towards the atomizing surface in a thickness direction of the liquid conducting body, the recess is in direct communication with the liquid storage cavity and configured for being filled with the atomizing liquid flowed directly from the liquid storage cavity, the atomizing liquid is capable of being conducted from the liquid storage cavity to the atomizing surface through a bottom wall of the recess, and a minimum conduction distance of the atomizing liquid from a bottom wall of the recess to the atomizing surface is less than a minimum conduction distance of the atomizing liquid from the liquid absorbing surface to the atomizing surface.

2. The atomizer according to claim 1, wherein the liquid absorbing surface and the atomizing surface are located on opposite sides of the liquid conducting body, respectively, and the liquid conducting body further comprises a side surface connecting the liquid absorbing surface and the atomizing surface.

3. The atomizer according to claim 1, wherein the minimum conduction distance from the bottom wall of the recess to the atomizing surface is less than a depth of the recess.

4. The atomizer according to claim 1, wherein a cross-sectional area of the recess gradually decreases along a direction from the liquid absorbing surface to the atomizing surface to allow atomizing liquid to flow through the recess towards the atomizing surface.

5. The atomizer according to claim 1, wherein the bottom wall of the recess is parallel to the atomizing surface.

6. The atomizer according to claim 1, wherein the liquid conducting body is a porous body.

7. The atomizer according to claim 6, wherein the liquid conducting body is a porous ceramic.

8. The atomizer according to claim 1, wherein the heating element is a heating coat, a heating circuit, a heating chip, or a heating net.

9. The atomizer according to claim 2, wherein the heating assembly further comprises a sealing element, the sealing element is at least partially located between the liquid conducting body and the liquid reservoir, so as to prevent the atomizing liquid in the liquid reservoir from directly flowing out without passing through the liquid conducting body.

10. The atomizer according to claim 9, wherein a side of the liquid conducting body adjacent to the liquid absorbing surface extends into the opening of the liquid reservoir, the sealing element comprises a sealing body sleeved on a side surface of the liquid conducting body.

11. The atomizer according to claim 10, wherein the sealing element further comprises a first latching portion and a second latching portion, the first latching portion is formed on an end of the sealing body adjacent to the liquid absorption, and the second latching portion is formed on an end of the sealing body adjacent to the atomizing surface, and the first latching portion and the second latching portion are latched to both ends of the liquid conducting body, respectively.

12. The atomizer according to claim 11, wherein the first latching portion and the second latching portion are both formed on an inner wall of the sealing body.

13. The atomizer according to claim 10, wherein the sealing element further comprises a third latching portion formed on an end of an outer wall of the sealing body adjacent to the atomizing surface.

14. The atomizer according to claim 10, wherein the sealing element further comprises a sealing ring formed on an end of an outer wall of the sealing body adjacent to the liquid absorbing surface.

15. The atomizer according to claim 11, wherein the sealing element is an integrated structure.

16. The atomizer according to claim 10, wherein an inner wall of the liquid reservoir provides a strengthening rib, and the strengthening rib is capable of abutting against a side of the heating assembly located in the liquid reservoir.

17. The atomizer according to claim 1, further comprising a housing, wherein the housing defines an air inlet and an air outlet, the heating assembly and the liquid reservoir are received in the housing, the heating assembly is located adjacent to the air inlet, and an airflow passage communicating the air n et and the air outlet is provided between the housing and the liquid reservoir.

18. The atomizer according to claim 17, wherein the heating assembly further comprises a sealing element, the sealing element is at least partially located between the liquid conducting body and the liquid reservoir, so as to prevent the atomizing liquid in the liquid reservoir from directly flowing out without passing through the liquid conducting body; and the sealing component defines a first notch, the opening end defines a second notch, and the first notch and the second notch communicate the air inlet and the airflow passage.

19. An electronic cigarette, comprising:

an atomizer according to claim 1 and a battery device comprising a cover, a battery, and a pogo pin, wherein the battery is received in the cover, the pogo pin is mounted on the cover, and the pogo pin is electrically connected to the battery and the heating element, respectively.

* * * * *